US007549847B1

(12) United States Patent
McClatchey

(10) Patent No.: US 7,549,847 B1
(45) Date of Patent: Jun. 23, 2009

(54) PORTABLE BULK TRANSFER PUMP WITH VARIABLE SPEED TRANSMISSION

(75) Inventor: Mark A. McClatchey, Wichita, KS (US)

(73) Assignee: Liquidynamics, Inc., Wichita, KS (US)

( * ) Notice: Subject to any disclaimer, the term of this patent is extended or adjusted under 35 U.S.C. 154(b) by 389 days.

(21) Appl. No.: 11/163,698

(22) Filed: Oct. 27, 2005

(51) Int. Cl.
*F04B 49/00* (2006.01)

(52) U.S. Cl. ..... 417/15; 417/212; 417/218; 417/223; 417/423.6; 417/319

(58) Field of Classification Search ..... 417/15, 417/42, 211.5, 212, 223; 74/10.5, 10.8, 10.9, 74/10.52, 842, 10.39, 397, 409, 325, 329, 74/395, 732.1, 372, 352, 341, 342; 180/337; 475/83, 88, 90; 477/35, 45
See application file for complete search history.

(56) References Cited

U.S. PATENT DOCUMENTS

| | | | | | |
|---|---|---|---|---|---|
| 804,212 | A | * | 11/1905 | Cary | 74/372 |
| 1,596,192 | A | * | 8/1926 | Knapp | 74/372 |
| 2,033,825 | A | * | 3/1936 | Guest | 74/10.5 |
| 3,181,473 | A | * | 5/1965 | Duron | 417/435 |
| 3,520,022 | A | * | 7/1970 | Lehner | 425/168 |
| D236,319 | S | | 8/1975 | Jakubuwski | |
| D239,155 | S | | 3/1976 | Kent | |
| 4,136,576 | A | * | 1/1979 | Usui et al. | 74/473.1 |
| D298,479 | S | | 11/1988 | Jacobs et al. | |
| D302,557 | S | | 8/1989 | Powers et al. | |
| 4,925,370 | A | * | 5/1990 | Tallarita | 417/15 |
| 4,951,792 | A | * | 8/1990 | Egawa | 192/69.9 |
| 5,073,258 | A | | 12/1991 | Boullain, II et al. | |
| 5,125,126 | A | | 6/1992 | Bonnant | |
| 5,142,730 | A | | 9/1992 | Braks et al. | |
| D340,786 | S | | 10/1993 | Jones | |
| D344,374 | S | | 2/1994 | Wulff | |

(Continued)

FOREIGN PATENT DOCUMENTS

FR 2679863 A1 * 2/1993

OTHER PUBLICATIONS

Dixon Pumps (available at: http://web.archive.org/web/20030814074034/http://www.dixonpumps.com/detail.shtml) published on Aug. 14, 2003, and visited on Nov. 28, 2007.*

(Continued)

*Primary Examiner*—Devon C Kramer
*Assistant Examiner*—Christopher Bobish
(74) *Attorney, Agent, or Firm*—Hovey Williams LLP

(57) ABSTRACT

A portable bulk transfer pump assembly (10) constructed in accordance with the principles of a preferred embodiment of the present invention is configured for transferring fluid (not shown) in bulk. The illustrated portable bulk transfer pump assembly (10) broadly includes a portable housing (12) that carries a pumping assembly (14). The portable housing (12) is sized and configured to both support the pumping assembly (14) and enable the entire pump assembly (10) to be readily and easily manually transported to and from pumping locations. The pumping assembly (14) is configured to pump low, medium, and high viscosity fluids utilizing a single pump (52) and a drive assembly (54) drivingly coupled to the pump (52) and selectively adjustable to operate the pump (52) at varying speeds. The illustrated drive assembly (54) includes a motor (80) and a variable speed transmission (82) disposed between the motor (80) and the pump (52).

13 Claims, 8 Drawing Sheets

U.S. PATENT DOCUMENTS

| | | | | | |
|---|---|---|---|---|---|
| D345,034 | S | | 3/1994 | Fitzwater | |
| D364,947 | S | | 12/1995 | Kent et al. | |
| 5,560,250 | A | * | 10/1996 | Hua | 74/371 |
| D375,590 | S | | 11/1996 | Steinhart et al. | |
| D394,132 | S | | 5/1998 | Dixon | |

OTHER PUBLICATIONS

Excerpt from Liquidynamics' Fluid Handling Technology Catalog; Front and Back Cover Sheets and p. 53 (Published Prior to Oct. 27, 2005), Showing the Prior Art Single Speed Transfer Pump Cart for Medium Viscosities P/N 33267-20cg and the Prior Art High Volume Transfer Pump Cart for Light Viscosities P/N 33267.

Prior Art Sales Flier from Dixon Pumps, Blade Master.

Prior Art Sales Flier from Dismas Pumps.

U.S. Appl. No. 11/862,265 entitled Pump System Including a Variable Frequency Drive Controller; Filed: Sep. 27, 2007; Applicant: Russold, Frank et al.

* cited by examiner

PORTABLE BULK TRANSFER PUMP WITH VARIABLE SPEED TRANSMISSION

BACKGROUND OF THE INVENTION

1. Field of the Invention

The present invention relates generally to portable bulk transfer pumps. More particularly, the present invention concerns a portable bulk transfer pump having a variable speed drive for the pump to enable the pumping of fluids having varying viscosities.

2. Discussion of Prior Art

Portable bulk transfer pumps are known in the art. These prior art pumps typically include a fixed speed electric motor powering a positive displacement pump, all of which is carried on a portable hand cart. These pumps are used to transfer various types of liquids. For example, in the oil industry, retailers utilize these prior art pumps to transfer lubricants from their initial bulk storage tanks to more convenient containers utilized in the retailer's plant. Such transfers may take place at many different locations in a single plant. Accordingly, these prior art pumps are readily and easily moved by hand. These prior art pumps are typically powered by 115 VAC outlets connected to 20 amp (or less) circuit breakers, which is the typical power system utilized in most plants. Suitable examples of these prior art portable bulk transfer pumps are Applicant's High Volume Transfer Pump and Light Viscosity Bulk Transfer Cart, available from Applicant as Part Nos. 33267 and 33271, respectively.

Although Applicant's prior art pumps are well advanced in the art, they, along with all prior art portable bulk transfer pumps, are subject to several problems and undesirable limitations. For example, a single retailer may have a plurality of different fluids that need transferred ranging from thin viscosity fluids, such as hydraulic fluids, light-weight engine oils (5W or 10W), and antifreeze, to medium viscosity fluids, such as 10W-30 or 10W-40 engine oils, to high viscosity gear oils, such as 80, 90, or 140 weight gear oils. Additionally, the viscosity of a particular fluid may change quite drastically with changes in temperature. It is common practice to have bulk lubricant products stored in unheated warehouses and delivered in unheated trucks. Therefore, if a prior art pump is configured to operate at a relatively high rate to pump a low viscosity fluid, it is inefficient and ineffective at pumping a high viscosity fluid. Furthermore, the power systems utilized in most plants severely limit the ability to transfer oil having relatively thick viscosities at high rates without causing the circuit breaker to open. To combat these problems, lubricant retailers have previously resorted to purchasing many types of pumps, each capable of handling fluids within narrow viscosity ranges (i.e., one pump for thin fluids, one pump for medium viscosity fluids, and one pump for highly viscous fluids). Such a practice is inefficient from a capital expense standpoint and can often times leave delivery personnel in the situation of not having the right pump for the right task. Heretofore, no single portable bulk transfer pump has been able to accommodate fluids having wide ranging viscosity values. Accordingly, there is a real and unfulfilled need in the art for an improved portable bulk transfer pump that is capable of handling fluids having widely varying viscosities in a timely and efficient manner.

SUMMARY OF THE INVENTION

The present invention provides an improved portable bulk transfer pump that does not suffer from the problems and limitations of the prior art pumps detailed above. The inventive pump enables the pumping of low, medium, and high viscosity fluids with a single pump assembly that is simply, yet sturdily constructed in a cost-efficient manner without sacrificing the portability of the assembly.

A first aspect of the present invention concerns a portable bulk transfer pump assembly broadly including a portable housing and a pumping assembly carried by the housing. The pumping assembly includes a pump adapted to be operated at varying speeds and a drive assembly drivingly coupled to the pump. The drive assembly is selectively adjustable to operate the pump at varying speeds.

A second aspect of the present invention concerns a portable bulk transfer pump assembly broadly including a portable housing and a pumping assembly supported on the housing. The housing includes a frame having a handle and at least a pair of wheels rotatably coupled relative to the frame. The pumping assembly includes a pump and a drive assembly drivingly coupled to the pump. The pump includes a rotatable driven shaft. The drive assembly includes a motor having a rotatable drive shaft. The drive assembly further includes a variable speed transmission drivingly coupling the drive shaft to the driven shaft.

A third aspect of the present invention concerns a method of transferring bulk fluids of varying viscosities. The method broadly includes the steps of (a) providing a single pump, (b) operating the pump at a first speed to pump a first fluid having a first viscosity, (c) after step (b), moving the pump, and (d) after step (c), operating the pump at a second speed different than the first speed to pump a second fluid having a second viscosity different than the first viscosity.

In a preferred embodiment, the portable bulk transfer pump assembly includes a constant speed electric motor drivingly coupled to a positive displacement pump through a varying speed transmission, all of which is carried on a two-wheeled hand cart. The transmission is a gear-type transmission with three speeds corresponding to pumping fluids at ten gallons per minute, twenty gallons per minute, and forty gallons per minute, respectively. The transmission has a simple construction and includes a manual gear bumper to align the intermeshing gears.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein.

Figure 3:
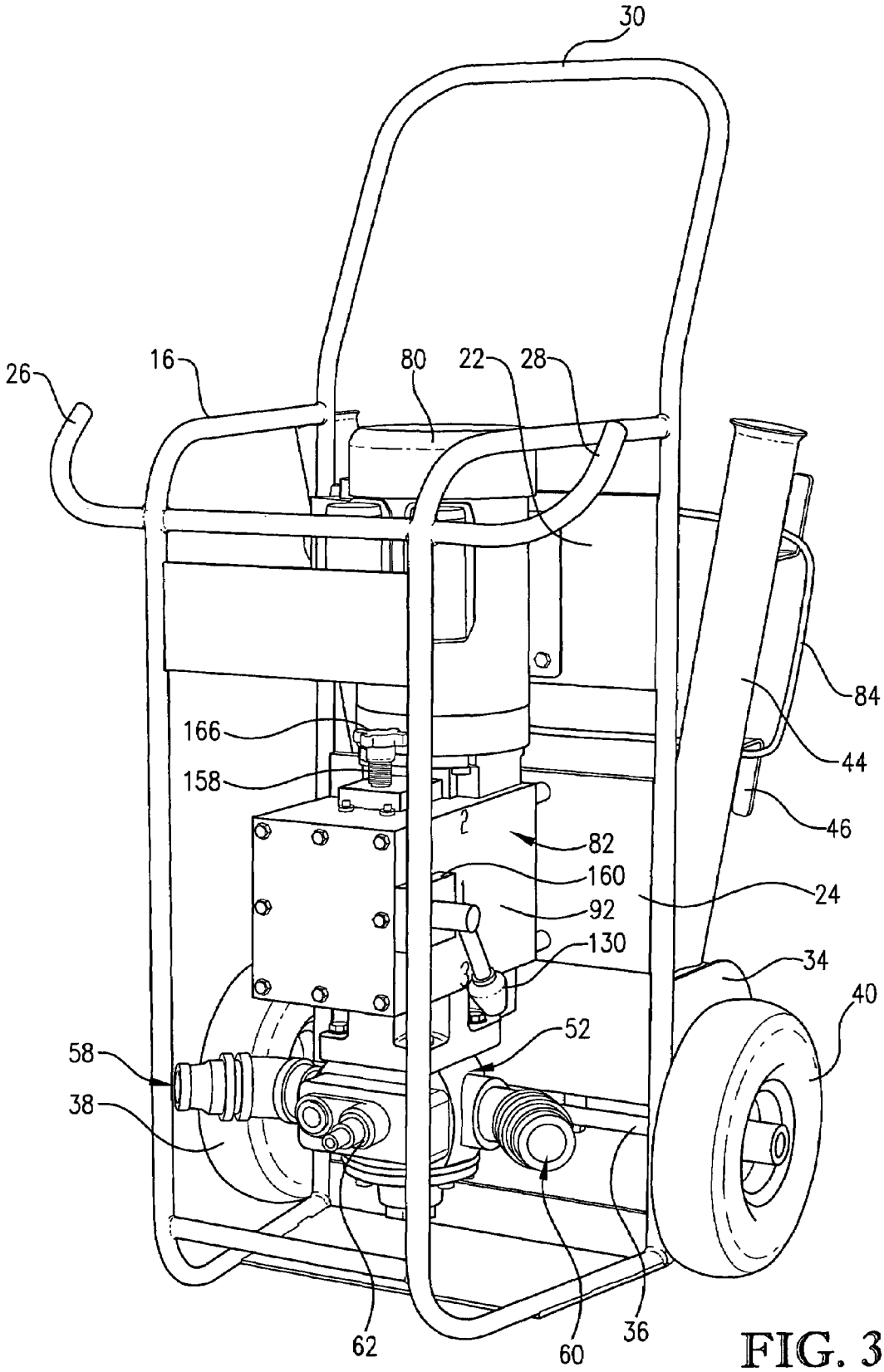
FIG. 3 is a front perspective view of the pump assembly illustrated in FIGS. 1-2 with the variable speed transmission illustrated in third gear and shown with the hoses, stinger, and nozzle removed.
Figure 4:
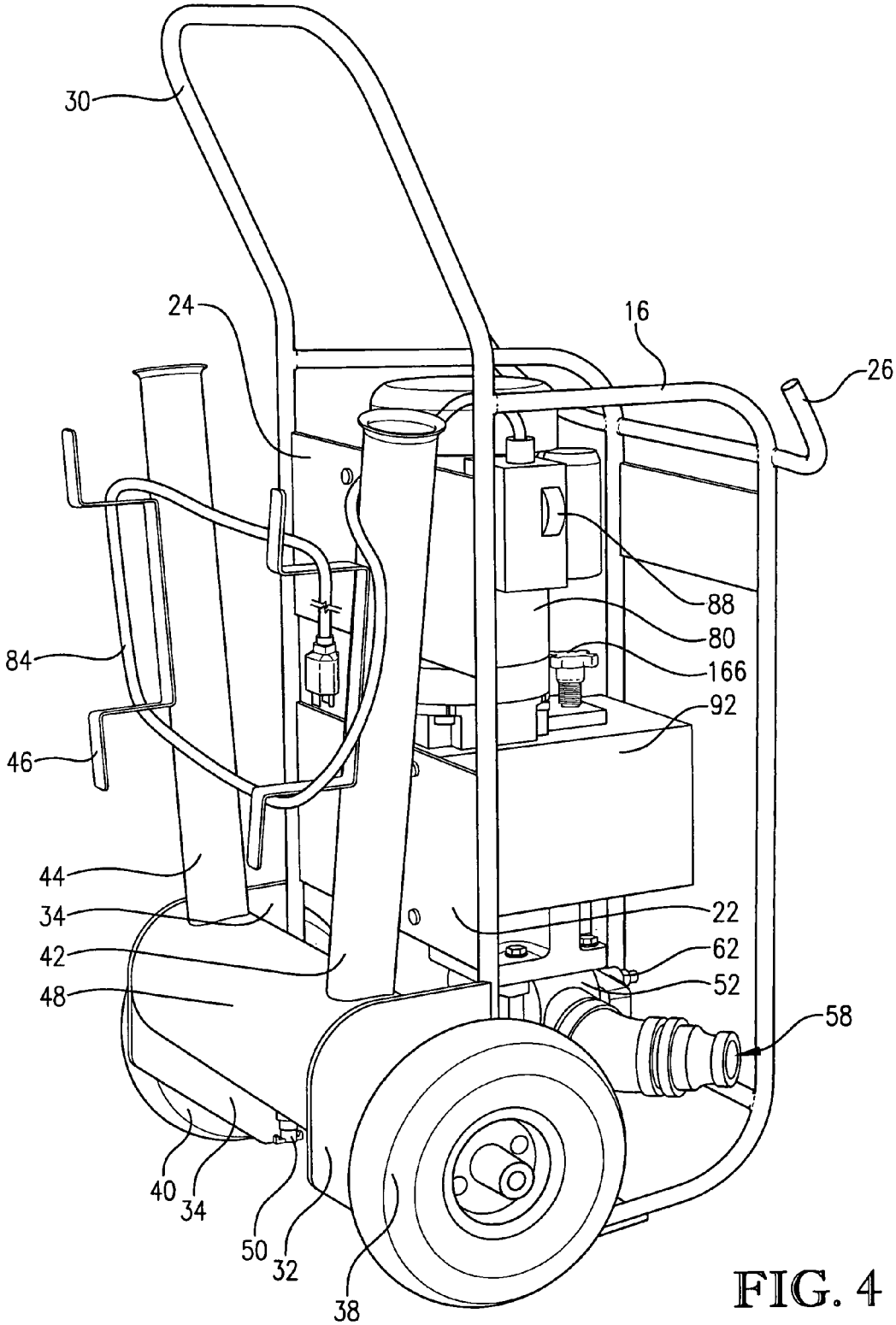
FIG. 4 is a rear perspective view of the pump assembly similar to FIG. 3.
Figure 5:
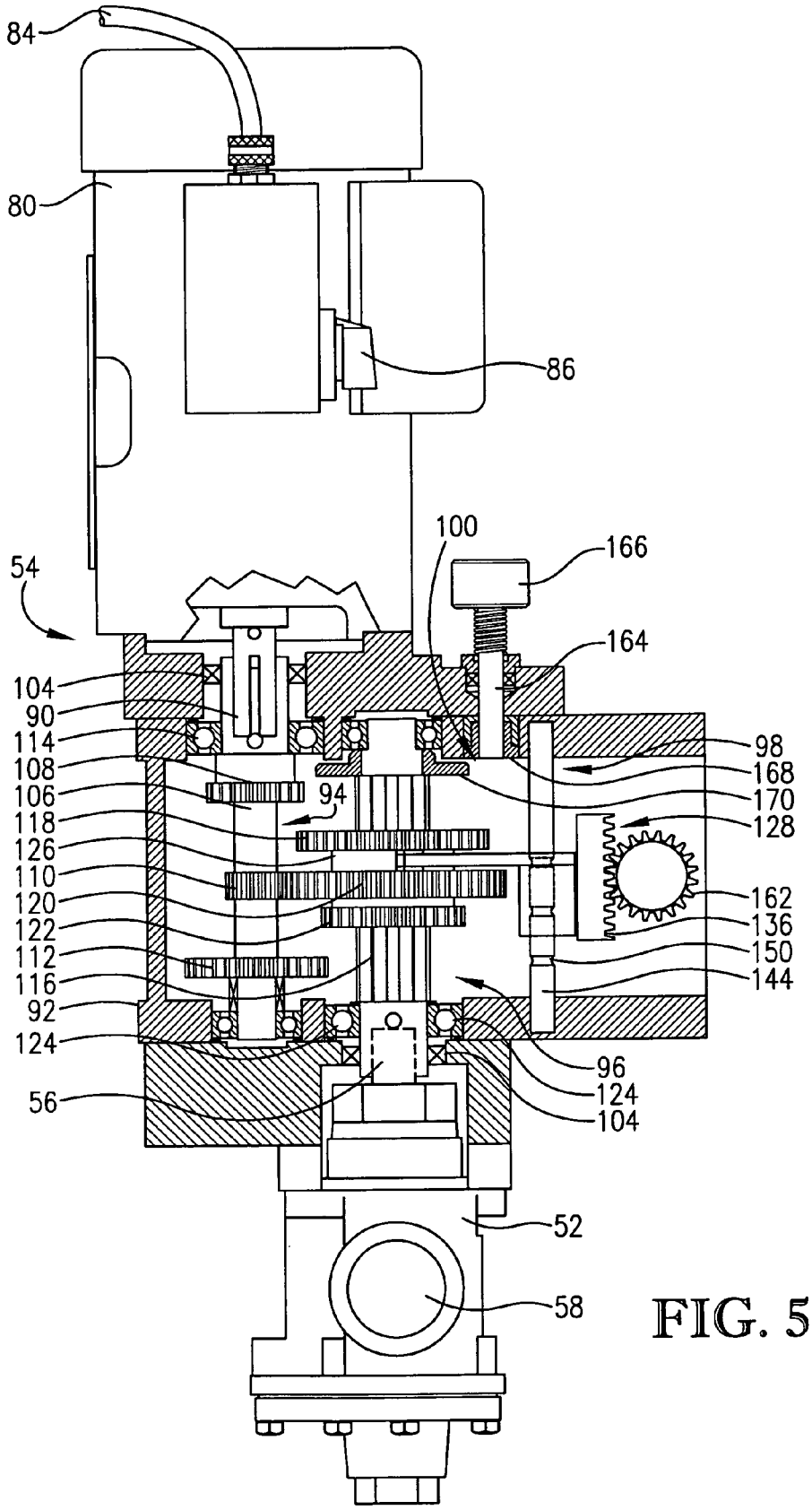
FIG. 5 is a fragmentary side elevational view of the pump assembly illustrated in FIGS. 1-4 illustrating the drive assembly and the pump with the transmission casing shown in section to illustrate the internal components of the transmission and with the transmission shown in first gear.
Figure 6:
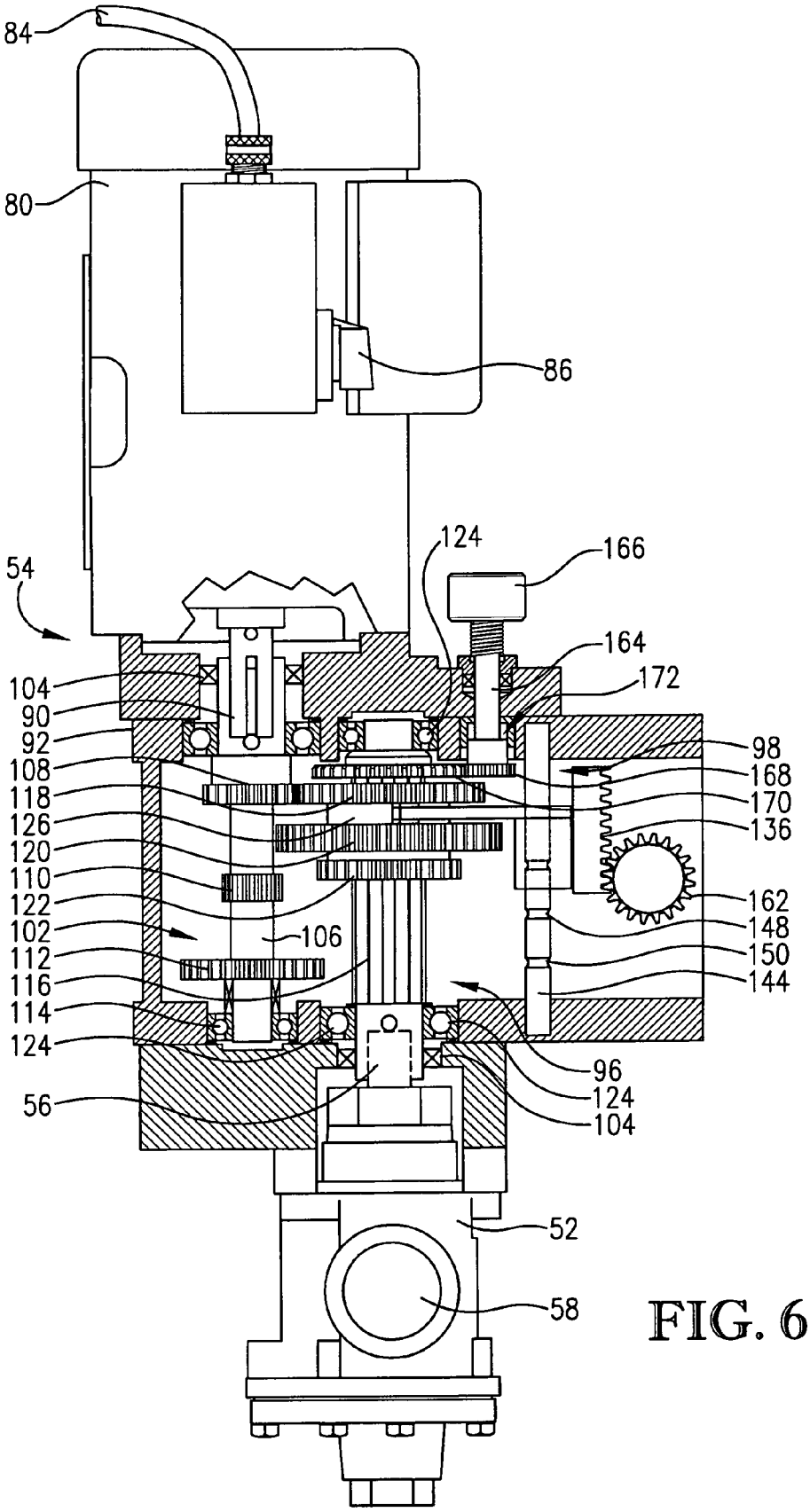
FIG. 6 is a fragmentary side elevational view of the pump assembly similar to FIG. 5 with the transmission shown in second gear and the gear bumper in the alignment position.
Figure 7:
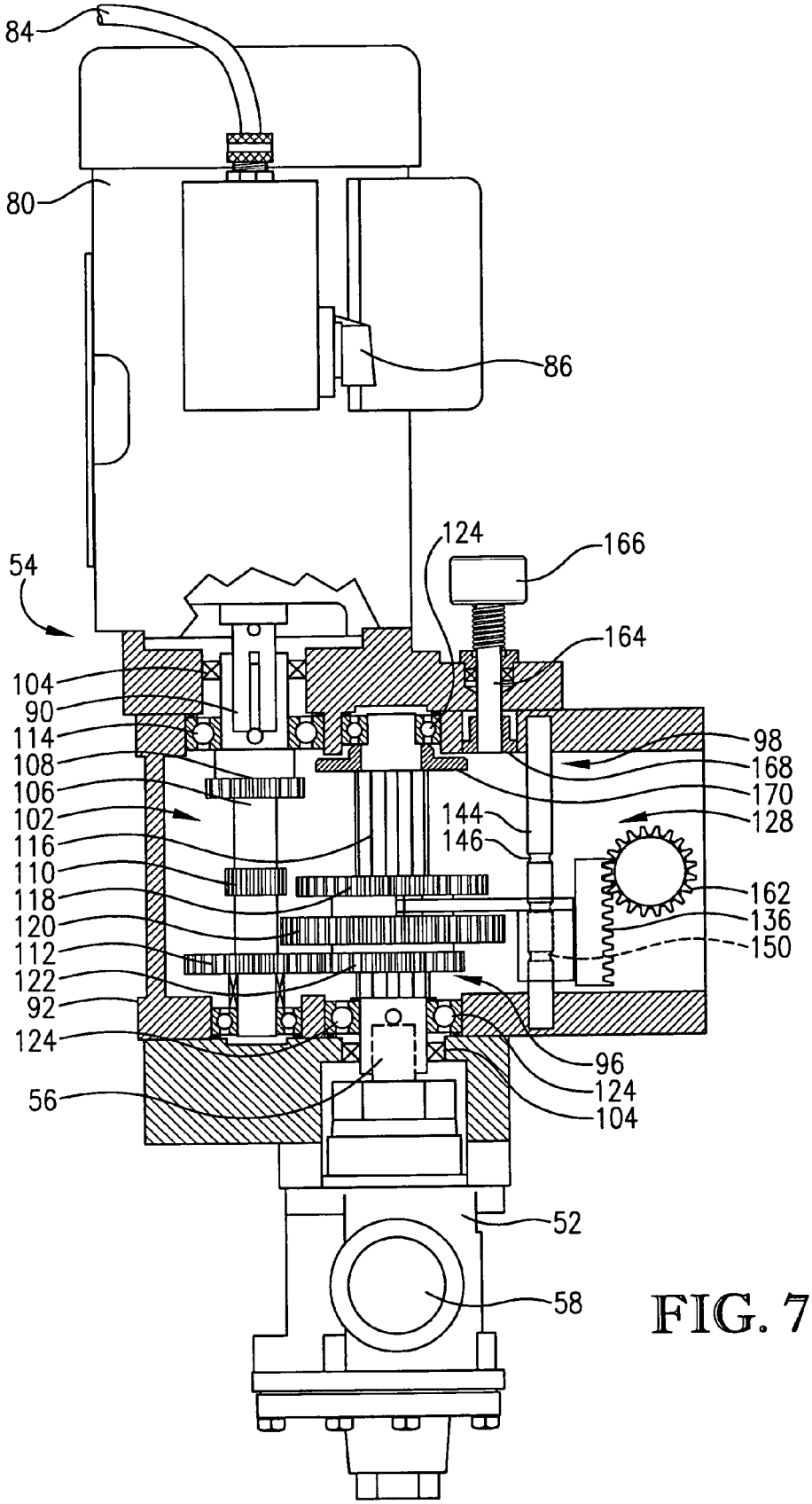
Figure 8:
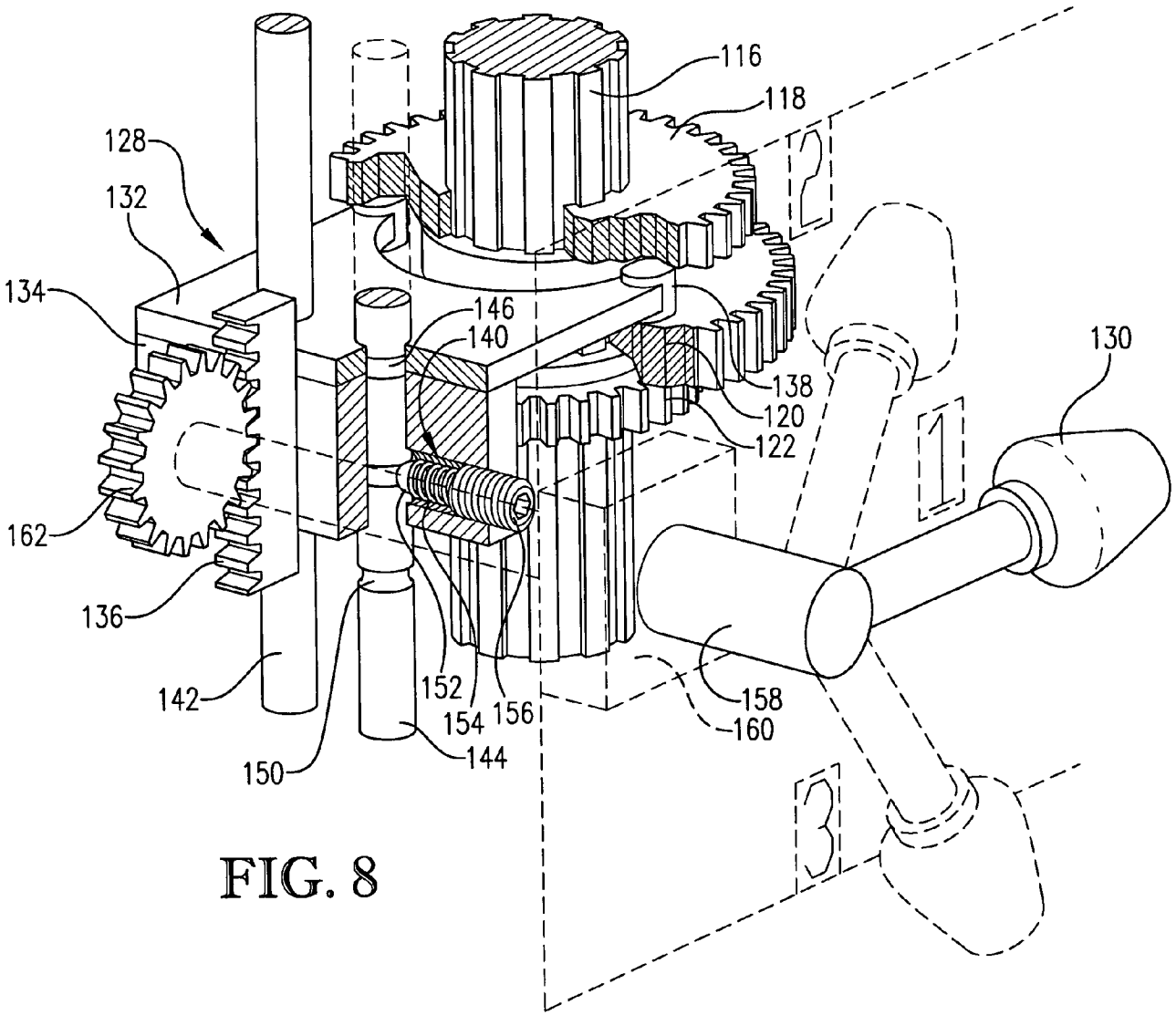

FIG. 7 is a fragmentary side elevational view of the pump assembly similar to FIGS. 5 and 6 with the transmission shown in third gear and the gear bumper out of the alignment position; and FIG. 8 is an enlarged, fragmentary perspective view of the transmission of the pump assembly illustrated in FIGS. 1-7 with some parts removed and others shown in section to illustrate some of the internal components of the transmission, particularly the shifting assembly with the gear key shown partially in section to reveal the internal components therein and with the shift handle shown in all three gears (second and third gears shown in phantom).

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 1:
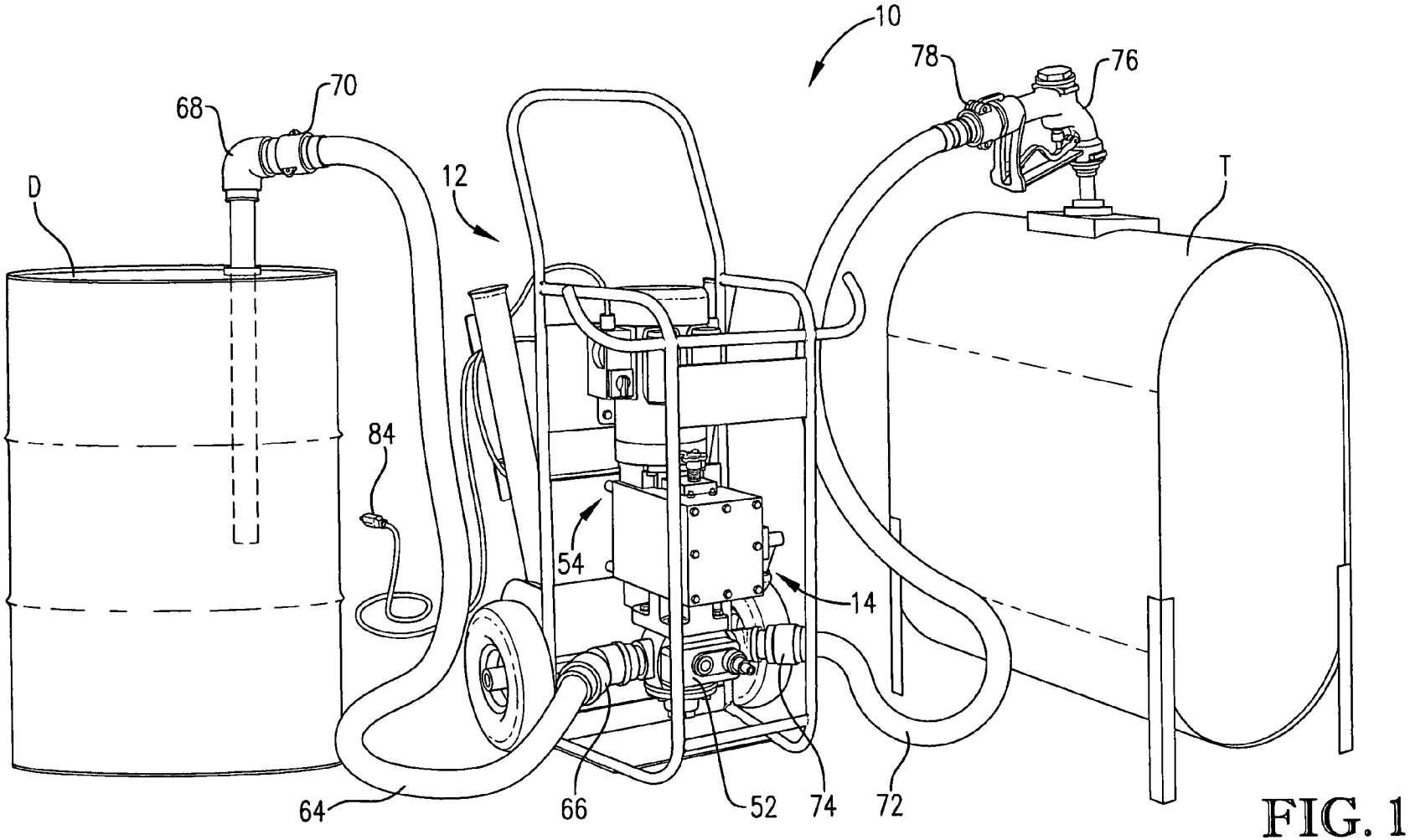
FIG. 1 is a front perspective view of a portable bulk transfer pump assembly constructed in accordance with a preferred embodiment of the present invention with the variable speed transmission illustrated in third gear and shown in use transferring fluid from a storage drum to another container.

FIG. 1 illustrates a portable bulk transfer pump assembly 10 constructed in accordance with the principles of a preferred embodiment of the present invention and configured for transferring fluid (not shown) from one container, such as a drum D, to another container, such as a holding tank T. While the principles of the present invention are particularly well suited for transferring lubricants and related fluids, such as engine oils, gear oils, antifreeze, and the like between containers typically utilized in a lubricant retailer's business, such as conventional fifty-five gallon drums and metered tanks or bins found in an automobile service or lubrication shop, these principles are not so limited and equally apply to the transfer of virtually any fluid in any setting. The illustrated portable bulk transfer pump assembly 10 broadly includes a portable housing 12 that carries a pumping assembly 14.

Figure 2:
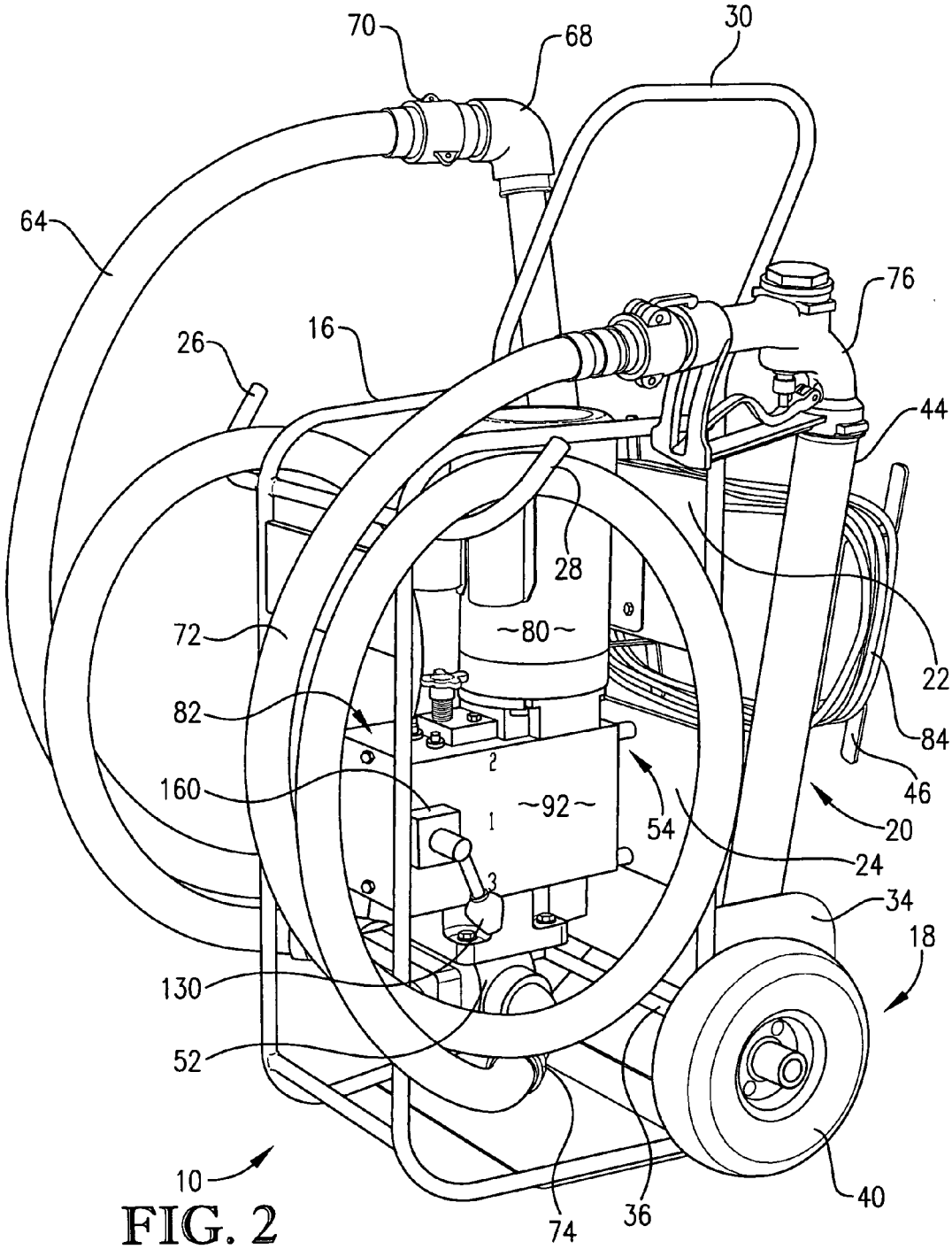
FIG. 2 is a side perspective view of the pump assembly illustrated in FIG. 1 with the variable speed transmission illustrated in third gear and shown in a transport position with the hoses and power cord wound up and stored on the portable housing.

The portable housing 12 is sized and configured to both support the pumping assembly 14 and enable the entire pump assembly 10 to be readily and easily manually transported to and from pumping locations. Turning to FIGS. 1-4, the illustrated portable housing 12 broadly includes a support frame 16, a wheel assembly 18 coupled to the frame 16, and storage receptacles 20 supported on the frame 16. In more detail, the illustrated support frame 16 comprises a rigid tubular cage including mounting plates 22 and 24 attached thereto, a pair of integrally formed hooks 26 and 28, and a handle 30. As will be further detailed below, the plates 22, 24 are for mounting components of the pumping assembly 14 thereto. The cage-like structure of the frame 16 both supports the components of the pumping assembly 14 and surrounds them for protection during transport. In this regard, the frame 16 may be formed from any suitable material capable of supporting the weight of the pumping assembly 14; however, a rigid metal structure is preferred. For purposes that will subsequently be described, the illustrated support frame 16 includes a pair of support flanges 32 and 34 (see FIG. 4) projecting out of the lower portion of the back of the frame 16. As shown in FIG. 2, and as will be further detailed below, the hooks 26, 28 are provided for hanging components of the pumping assembly 14 when not in use. Thus all components of the pumping assembly 14 may be stored on board of the pump assembly 10 allowing for convenient transport of the assembly 10 between work stations and storage locations. In this regard, the handle 30 allows a user to grasp the portable housing 12 by hand to easily maneuver the pump assembly 10 without further mechanical assistance. Although the illustrated handle 30, as well as the hooks 26, 28 are integrally formed with the frame 16, these components could be variously alternatively configured and need not be integrally formed.

As indicated above, the housing 12 is readily and easily portable and in the illustrated housing 12, the wheel assembly 18 facilitates this portability. The illustrated wheel assembly 18 includes an axle 36 and a pair of rotatable wheels 38 and 40 mounted on the opposing ends of the axle 36. Perhaps as best shown in FIGS. 3 and 4, the axle 36 is supported on the flanges 32, 34 and could either be fixed thereto or rotatably supported therein, such as with bushings, or bearings, or the like. The illustrated wheels 38, 40 include hubs mounted on the axle 36 for rotation and pneumatic tires mounted on the hubs to provide adequate support and easy maneuverability of the pump assembly 10. Thus, the frame 16 and wheel assembly 18 cooperate to provide a hand cart or dolly to which the pumping assembly 14 is secured to and transported on. Although the wheel assembly 18 could be variously alternatively configured, it is important the housing 12 is easily and readily manually portable when loaded with the pumping assembly 14.

As previously indicated, the portable housing 12 is also configured to stow and support the pumping assembly 14 during transport and storage. In this regard, the storage receptacles 20 are sized and configured to conveniently store various components of the pumping assembly 14 when not in use. Perhaps as best shown in FIG. 4, the illustrated receptacles 20 include a pair of holsters 42 and 44, as well as a pair of brackets 46 fixed to the corresponding holsters 42, 44. In more detail, and for purposes that will subsequently be described, the holster 42 is sized and configured to receive a stinger and the holster 44 is sized and configured to receive a nozzle (see FIG. 2). The bottom ends of each of the holsters 42, 44 communicate with an integrally formed drip tank 48 into which any excess fluid from the stored components may be collected during storage thereby avoiding discharge of fluid onto the ground. The tank 48 is supported between the flanges 32, 34 and is equipped with a petcock 50 (see FIG. 4) to facilitate the draining of fluid from the tank 48. The brackets 46 are configured to receive a power cord, which may be wound around the brackets 46. Thus, all of the components of the pumping assembly 14 (as detailed below) may be stored on board the portable housing 12 allowing for convenient transport of pump assembly 10 between work stations and storage locations.

It is within the ambit of the present invention to use various alternative configurations for the housing 12. However, it is important that the housing be configured to support the pumping assembly and enable the entire pump assembly to be readily and easily manually transported.

The pumping assembly 14 is carried on the portable housing 12 and is configured to pump low, medium, and high viscosity fluids utilizing a single pump. The illustrated pumping assembly 14 broadly includes a pump 52 and a drive assembly 54 (see FIG. 2) drivingly coupled to the pump 52 and selectively adjustable to operate the pump 52 at varying speeds. The illustrated pump 52 is configured to pump fluids having various viscosities, ranging from low viscosities (e.g., less than about 230 cps), to medium viscosities (e.g., between about 230 cps and about 600 cps), and high viscosities (e.g., up to about 4900 cps). In more detail, the illustrated pump 52 is a positive displacement pump that can operate at varying speeds to pump fluids at rates ranging up to one-hundred gallon per minute. Particularly, the illustrated pump 52 is an internal gear pump driven by rotating a driven shaft 56 (see FIGS. 5-7). The pump 52 bolts on to the bottom of the lower housing, as further detailed below, of the drive assembly 54 (see FIG. 2). As shown in FIG. 3, the pump 52 includes an inlet 58 and an outlet 60. In one manner well known in the art, when the driven shaft 56 is rotated, fluid is pressurized between the inlet 58 and the outlet 60 causing fluid to flow into the inlet 58, and out of the outlet 60.

Because the pump 52 pumps fluids of various viscosities, the pump 52 preferably includes a by-pass valve 62 as a safety feature to prevent dangerous pressure buildups therein. By-pass valves are well known in the art and commonly included on pumps to guard against pump damage caused by pressure build up attendant to the pumping of viscous fluids. The illustrated by-pass valve 62 is configured so that at a pre-determined pressure, fluid will be released from the pump 52. As will be further detailed below, the power source for the drive assembly 54 may be a traditional 115 VAC with a circuit breaker of twenty amps or less. Accordingly, it is important the bypass pressure is set to allow the pump 52 to pump high viscosity fluids without drawing too much current under these typical settings. However, the pre-determined pressure must be set high enough that low viscosity fluids can be pumped through the inlet 58 and out of the outlet 60 without directly bypassing through the valve 62. Preferably, the by-pass valve 62 is set to release at a pressure of less than about 35 psi, more preferably between about 10-30 psi, and most preferably between about 20-25 psi.

The pump 52 could be variously alternatively configured. For example, if a positive displacement pump is utilized, it need not be an internal gear pump, but could be an external gear pump or a vane pump. Although a positive displacement pump is preferred, any other suitable type of pump could be utilized. However, it is important that whatever type of pump is utilized be able to operate at varying speeds to pump fluids of various viscosities.

As indicated above, the illustrated pump assembly 10 is particularly well suited for bulk transfer of liquids. In this regard, the illustrated pumping assembly 14 includes hose assemblies configured to facilitate pumping liquids from one container to another. In more detail, the pumping assembly 14 includes a suction hose 64 operable to be placed in fluid communication with the inlet 58. In one manner known in the art, one end of the illustrated hose 64 is coupled to the pump 52 via a cam lock coupling 66 (see FIG. 1) to enable the hose 64 be easily coupled to and removed from the pump 52. The other end of the suction hose 64 is removably coupled to a stinger 68 via a quick disconnect cam lock 70 (see FIG. 1). In a similar manner, the pumping assembly 14 includes a discharge hose 72 operable to be placed in fluid communication with the outlet 60. One end of the hose 72 is coupled to the pump 52 via a cam lock coupling 74 (see FIG. 1). The other end of the discharge hose 72 is removably coupled to a nozzle 76, having a high flow control valve, via a quick disconnect cam lock 78 (see FIG. 1). As shown in FIG. 2, the hoses 64, 72 can be wound up and stowed on the corresponding hooks 26, 28, respectively, and the stinger 68 and the nozzle 76 can be stowed in the corresponding holsters 42, 44, respectively, during storage and transport of the pump assembly 10. In the illustrated pumping assembly 14, the pump outlet 60 (and discharge hose 72) present diameters which are smaller than those for the pump inlet 58 (and suction hose 64). For example, the illustrated discharge hose 72 preferably presents a diameter of approximately one and one-half inches and the suction hose 64 preferably presents a diameter of approximately two inches. However, the hoses could be variously alternatively configured and connected to the pump.

As previously indicated, the drive assembly 54 is drivingly coupled to the pump 52 and is selectively adjustable to operate the pump 52 at varying speeds. The illustrated drive assembly 54 includes a motor 80 operable to power the pumping assembly 14 and a variable speed transmission 82 disposed between the motor 80 and the pump 52 and operable to transfer power from the motor 80 to the pump 52 at selectable varying speeds. In more detail, and turning to FIGS. 5-8, the illustrated motor 80 is a constant speed electric motor. In this regard, the motor 80 includes a power cord 84 for placing the motor 80 in power communication with a traditional power source, such as either a 115 V system or a 230 V system. The illustrated motor 80 is operated by a dial switch 86 and is equipped with an ammeter 88 which permits the operator to monitor the current drawn by the motor 80. The current drawn by the motor 80 directly correlates to the load placed on the motor 80 by the nature of the fluid being pumped by the pumping assembly 14. Thus, the more viscous the fluid, the greater the load on the motor 80. As typical electric circuits to which motor 80 is connected generally comprise circuit breakers permitting twenty amps or less, the ability to monitor the current draw will permit the user to operate the pumping assembly 14 in a manner which avoids opening the circuit breaker. Inadvertent "tripping" of circuit breakers may lead to inefficient fluid transfer rates and significant down time.

The motor 80 preferably presents a power output of between about 0.25-10 hp, more preferably between about 0.5-5 hp, and most preferably about 2 hp. The illustrated motor 80 includes a rotatable drive shaft 90. For purposes that will subsequently be detailed, the drive shaft 90 extends out of the bottom of the housing of the motor 80 (see FIG. 5). The motor 80 preferably is operable to rotate the drive shaft 90 within the range of 1000-3000 rpm, more preferably between about 1500-2500 rpm, and most preferably about 1725 rpm. Additionally, the motor 80 is preferably a fan-cooled motor that is totally enclosed to prevent any debris or foreign objects from fouling the operation thereof. One suitable such motor is the 2 HP, TEFC, 115/230 motor available from Leeson Electric Corporation of Grafton, Wis. as Model No. 120274. However, any suitable motor will suffice.

The illustrated motor 80 is bolted to the upper mounting plate 22 of the portable housing 12 so that the motor 80 is primarily enclosed within the frame 16 for protection. The power cord 84 can be wound around the brackets 46 (see FIG. 2) during storage and transport of the pump assembly 10. It is within the scope of the present invention to utilize various alternative configurations for powering the pumping assembly 14. For example, the motor could be a variable speed motor wherein the output of the variable motor is adjusted to control the speed of the pump thereby making a separate transmission unnecessary. However, the versatility of a pump unit comprising a variable speed motor without a separate transmission may be limited with respect to the viscosity ranges of fluids to be pumped as these motors tend to experience a decrease in available torque as the motor speed is decreased. Thus, if a variable speed motor is utilized, it is preferable that the variable speed motor be capable of compensating for this decrease in torque as much as possible.

As indicated above, the variable speed transmission 82 is disposed between the motor 80 and the pump 52 and operable to transfer power from the motor 80 to the pump 52 at selectable varying speeds. As shown in FIGS. 5-8, the illustrated transmission 82 is a gear-type transmission having multiple selectable gears that transfers power from the drive shaft 90 of the motor 80 to the driven shaft 56 of the pump 52. The illustrated variable speed transmission 82 broadly includes a casing 92 housing the transmission components, an input shaft assembly 94 coupled to the drive shaft 90, an output shaft assembly 96 coupled to the driven shaft 56, a shifting assembly 98 for selecting the gear setting, and a gear bumper assembly 100 for aligning the input and output assemblies 94, 96. In more detail, the casing 92 is configured to house the components of the transmission 82 and support the transmission 82 (and the pump 52) on the portable housing 12 adjacent the motor 80. The illustrated casing 92 is a metal casing that bolts to the lower mounting plate 24 of the support frame 16 (see FIGS. 2-4). The casing 92 sealingly engages the motor 80 and the pump 52. In this regard, the top of the casing 92 bolts to the motor 80 and the pump 52 bolts to the bottom of the casing 92. The casing 92 defines an internal chamber 102 for housing the majority of the components of the transmission 82. The chamber 102 is configured to sealingly contain at least some lubricant, such as transmission fluid or oil. In the illustrated transmission 82, the lubricant level is such that the working components are not totally submerged but rather contact the lubricant to distribute the lubricant in a mist throughout the internal chamber 102 during operation. In this regard, seals 104 are provided where shafts enter the casing 92, such as the drive shaft 90 and the driven shaft 56.

The input shaft assembly 94 includes a rotatable input shaft 106 and a plurality of drive gears 108, 110, and 112, spaced along the input shaft 106. One end of the input shaft 106 is coupled with the drive shaft 90 of the motor 80, such as keyed thereto, for rotation therewith. Each end of the input shaft 106 is rotatably supported on the inside wall of the casing 92 by bearing assemblies 114. Each of the drive gears 108, 110, 112 are toothed gears that are fixedly secured to the input shaft 106, such as integrally formed therewith or press fit thereon, for rotation therewith. For purposes that will subsequently be described, the drive gears 108, 110, 112 are sized and configured to have different diameters and thus a different number of teeth.

The output shaft assembly 96 includes a rotatable output shaft 116 and a plurality of driven gears 118, 120, and 122 slidably received on the output shaft 116 for rotation therewith. In more detail, the output shaft 116 is spaced from the input shaft 106 with one end being coupled to the driven shaft 56 of the pump 52, such as keyed thereto, for rotation therewith. Each end of the output shaft 116 is rotatably supported on the inside wall of the casing 92 by bearing assemblies 124. The output shaft 116 is externally splined (see FIG. 8) and the driven gears 118, 120, 122 are each internally splined to cooperate with the output shaft 116 to rotate therewith. This splined configuration enables the driven gears 118, 120, 122 to also slide along the output shaft 116. The illustrated driven gears 118, 120, 122 are integrally formed as a single unit so that shifting of one the driven gears 118, 120, 122 relative to the output shaft 116 causes all of the driven gears 118, 120, 122 to similarly shift. However, these gears need not be integrally formed, nor do they need to shift simultaneously. The driven gears 118, 120, 122 are sized and configured to have different diameters and thus a different number of teeth. Particularly, the driven gear 118 is sized and configured so that when it is aligned with the drive gear 108, the gears 108, 118 drivingly intermesh for counter rotation with one another. Similarly, the driven gear 120 is sized and configured so that when it is aligned with the drive gear 110, the gears 110, 120 drivingly intermesh for counter rotation with one another. Likewise, the driven gear 122 is sized and configured so that when it is aligned with the drive gear 112, the gears 112, 122 drivingly intermesh for counter rotation with one another. The driven gears 118, 120, 122 are sufficiently spaced along the output shaft 116 so that only one driven gear 118, 120, 122 and only one drive gear 108, 110, 112 can be drivingly intermeshed at any given time and position. In other words, the gears that are not intermeshed do not interfere with the counter rotation of the corresponding gears that are intermeshed. For purposes that will subsequently be described, a smooth hub section 126 is defined between driven gears 118 and 120.

As just indicated, each of the driven gears 118, 120, 122 shift with one another relative to the input shaft 116 for intermeshing alignment with the corresponding drive gear 108, 110, 112. In the illustrated transmission 82, this shifting is selectively caused by the shifting assembly 98. The illustrated shifting assembly 98 includes a gear key 128 operably linked with a shift handle 130. In more detail, and perhaps as best shown in FIG. 8, the gear key 128 includes a plate 132, a block 134 fixed to the plate 132, and a rack 136 fixed to the block 134. The plate 132 is forked on one end so as to fit between the driven gears 118 and 120 and fit around the smooth hub section 126. This forked end of the plate 132 includes a pair of guards 138 which contact gears 118 and/or 120 during shifting of the driven gears 118, 120, 122. The guards 138 may be integrally formed with the plate 132 or may comprise a resilient material secured thereto to reduce any rattle. For example, the guards 138 may comprise a wear resistant metal or a durable synthetic resin material which resists friction and wear due to contact with the gears 118, 120. For purposes that will subsequently be described, both the plate 132 and the block 134 fixed thereto, include apertures formed there through configured to slidably receive a pair of pins. Additionally, the block 134 includes a keyway 140 in communication with one of the apertures (see FIG. 8). The illustrated rack 136 includes ten teeth and is fixed to both the plate 132 and the block 134 positioned on the end of the plate 132 opposite of the forked end.

The gear key 128 is slidable along a pair of pins, key pin 142 and detent pin 144. The key pin 142 is fixedly supported on the inside wall of the casing 92 and is spaced from and extends parallel to the output shaft 116. Similarly, the detent pin 144 is fixedly supported on the inside wall of the casing 92 and is spaced from and extends parallel to the key pin 142. The pins 142, 144 are received in the apertures formed through the gear key 128. The detent pin 144 includes three grooves 146, 148, 150 formed therein. A ball 152 biased by a spring 154, which is maintained in compression by a set screw 156, is received in the keyway 140, which extends perpendicular to the detent pin 144. As will be further detailed below, the ball 152 generally resides in one of the grooves 146, 148, 150 to "lock" the gear key 128 into one of three positions corresponding with a respective pair of the gears 108,118, 110,120, and 112,122 being drivingly intermeshed. However, as the gear key 128 is caused to slide relative to the pins 142, 144, the moment force provided on the rack 136 is sufficient to force the ball 152 out of the corresponding groove 146, 148, 150 thereby further compressing the spring 154 and enabling the gear key 128 to freely slide along key pin 142 and detent pin 144. As the gear key 128 slides, once the next corresponding pair of gears intermeshes, the ball 152 pushes into the next groove thereby "locking" the gear key 128 into position.

The gear key 128 is linked to the shift handle 130 so that shifting of the handle 130 causes the gear key 128 to slide which in turn causes corresponding pairs of the gears 108, 118, 110,120, and 112,122 to become drivingly intermeshed. In more detail, the shift handle 30 is fixed to one end of a rotatable actuator shaft 158. The actuator shaft 158 is rotatably supported on the casing 92 by bushings (with only bushing 160 being shown in FIG. 8). The outward end of the shaft 158 extends through the wall of the casing 92 to engage the handle 30. A pinion 162 is fixed to the actuator shaft 158 for rotation therewith inside of the internal chamber 102. The pinion 162 is positioned, sized, and configured to remain in intermeshing engagement with the rack 136. The illustrated pinion 162 has twenty teeth. As the shift handle 130 is shifted, the actuator shaft 158 rotates, as does the pinion 162 thereby causing the rack 136 and thus the gear key 128 to slide along the pins 142, 144.

The illustrated variable speed transmission 82 has three gear settings, a first gear, a second gear, and a third gear, corresponding with the designations "1," "2," and "3," respectively, on the outside of the casing 92 adjacent the shift handle 130 (see FIG. 8). When the shift handle 130 is in the first gear position, as shown in solid in FIG. 8, the ball 152 is detented into the groove 148 and the drive gear 110 drivingly intermeshes the corresponding driven gear 120 as shown in FIG. 5. This first gear position represents the lowest gear setting for the illustrated transmission 82 as the smallest drive gear 110 is intermeshed with the largest driven gear 120. In the illustrated transmission 82, this gear setting is a 4:1 gear ratio (drive gear to driven gear). With the illustrated pumping assembly 14, this first gear position is operable to cause the pump 52 to deliver between about 1-15 gallons per minute of a particular fluid, more preferably between about 5-12 gallons per minute, and most preferably about 10 gallons per minute. The illustrated first gear position is particularly well suited for pumping high viscosity fluids, such as fluids having viscosities from about 600 cps up to about 4900 cps.

In order to shift the illustrated transmission 82 from the first gear position into the second gear position, the user shifts the shift handle 130 up, or counterclockwise when viewed as in FIG. 8, out of setting "1" into setting "2." As the handle 130 is rotated upward, the pinion 162 drives the rack 136 upward causing the ball 152 to detent out of the groove 148, thus allowing the gear key 128 to slide upward along the pins 142, 144 thus causing the driven gears 118, 120, 122 to slide upward along the output shaft 116. When the shift handle 130 reaches the setting "2," the transmission 82 is in second gear position as shown in FIG. 6. When the transmission 82 is in this second gear position, as shown in FIG. 6, the ball 152 is detented into the groove 146 and the drive gear 108 drivingly intermeshes the corresponding driven gear 118. This setting represents the intermediate gear setting for the illustrated transmission 82 as the medium-sized drive gear 108 is intermeshed with the medium-sized driven gear 118. In the illustrated transmission 82, this gear setting is a 2:1 gear ratio. This gear setting is operable to cause the pump 52 to deliver between about 15-30 gallons per minute of a particular fluid, more preferably between about 18-25 gallons per minute, and most preferably about 20 gallons per minute. This second gear position is particularly well suited for pumping medium viscosity fluids, such as fluids having viscosities between about 230 cps up to about 600 cps.

In order to shift the illustrated transmission 82 from the second gear position into the third gear position, the user shifts the shift handle 130 down, or clockwise when viewed as in FIG. 8, out of setting "2" into setting "3." As the handle 130 is rotated downward, the pinion 162 drives the rack 136 downward causing the ball 152 to detent out of the groove 146, thus allowing the gear key 128 to slide downward along the pins 142, 144 thus causing the driven gears 118, 120, 122 to slide downward along the output shaft 116. When the shift handle 130 reaches the setting "3," the transmission 82 is in third gear position as shown in FIGS. 1-3 and 7. When the transmission 82 is in this third gear position, as shown in FIG. 7, the ball 152 is detented into the groove 150 and the drive gear 112 drivingly intermeshes the corresponding driven gear 122. This setting represents the highest gear setting for the illustrated transmission 82 as the largest-sized drive gear 112 is intermeshed with the smallest-sized driven gear 122. In the illustrated transmission 82, this gear setting is a 1:1 gear ratio. This gear setting is operable to cause the pump 52 to deliver between about 35-50 gallons per minute of a particular fluid, more preferably between about 38-45 gallons per minute, and most preferably about 40 gallons per minute. This third gear position is particularly well suited for pumping low viscosity fluids, such as fluids having viscosities of less than about 230 cps.

In certain circumstances, the teeth of the respective drive gear may not be in alignment with the spaces between teeth of the corresponding driven gear so as to permit intermeshing between the gears as gear settings are changed. In the illustrated transmission 82, the gear bumper assembly 100 is provided to rectify this problem. The gear bumper assembly 100 generally comprises a spring-biased rotatable bumper shaft 164 presenting a knurled knob 166 at one end and a bumper gear 168 fixed at the opposite end for rotation therewith. The gear bumper assembly also includes an alignment gear 170 fixed to the input shaft 116 for rotation therewith. As shown in FIG. 6, a user can depress the knob 166, and rotate as needed, until the bumper gear 168 becomes intermeshed with the alignment gear 170 in an alignment position. Such adjustment can easily be performed by feel. Once the bumper gear 168 is intermeshed with the alignment gear 170, the user can turn the knob 166 (clockwise or counterclockwise) while at the same time shifting the handle 130 into the desired gear setting, i.e., when the corresponding drive and driven gears intermesh and the gear key 128 is locked into place. Once the desired gear setting has been achieved, the knob 166 may be released thereby disengaging the bumper gear 168 from the alignment gear 170. The spring biases the shaft 164 upward thereby returning the bumper gear 168 into a recess 172 formed in the casing 92 as shown in FIGS. 5 and 7. The bumper shaft 164 is also provided with a seal in order to prevent any transmission fluid from escaping past the shaft 164.

It is within the scope of the present invention to utilize various alternative configurations for the variable speed transmission. For example, the gear shifting and/or gear alignment could be automated. Additionally, the gear bumper assembly could be replaced with something similarly suited or eliminated altogether. For example, the gear shift handle could be replaced with a switch that selectively operates a small electric motor which rotates the gears into alignment and from position to position. The transmission need not be a gear-type transmission. However, it is important that the pump assembly be configured to pump fluids having various viscosities utilizing a single pump.

In operation, and as shown in FIG. 1, the hoses 64 and 72 are quick connected to the pump 52 and the stinger 68 is inserted through a bung into the drum D. The nozzle 76 is inserted into the opening of the holding tank T. The shift handle 130 is rotated to the desired gear setting—and the bumper gear assembly 100 is utilized to align the gears if necessary. The power cord 84 can be plugged into a 115 VAC outlet and the dial switch 86 can then be turned to the "on" position. Once the bulk fluid is transferred, the motor 80 can be turned off and the stinger 68 and nozzle 76 can be stowed in their respective holsters 42, 44. The cord 84 and hoses 64, 72 can be stowed on their corresponding brackets 46 and hooks 26, 28. The entire pump assembly 10 can then be manually transported to either a storage location or another pumping location. If another pumping operation is desired, particularly one involving a fluid having a different viscosity than the first fluid, the above process is repeated with the shift handle 130 being moved to the appropriate gear setting.

The preferred forms of the invention described above are to be used as illustration only, and should not be utilized in a limiting sense in interpreting the scope of the present invention. Obvious modifications to the exemplary embodiments, as herein above set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A portable bulk transfer pump assembly comprising:

a portable housing; and a pumping assembly carried by said housing, said pumping assembly including a pump adapted to be operated at varying speeds and a drive assembly drivingly coupled to said pump, said pump including a rotatable driven shaft, said drive assembly being selectively adjustable to operate the pump at varying speeds and including a motor having a rotatable drive shaft and a variable speed transmission drivingly coupling the drive shaft to the driven shaft, said transmission including at least one rotatable transmission shaft and a plurality of transmission gears, at least one of the gears being shiftable relative to the transmission shaft between a first position wherein the transmission shaft rotates at a first speed and a second position wherein the transmission shaft rotates at a second speed, said first and second speeds being different, said at least one rotatable transmission shaft comprising an input shaft coupled to the drive shaft, said plurality of transmission gears including at least a first and a second drive gear spaced along the transmission shaft, said transmission further including a rotatable output shaft coupled to the driven shaft, said plurality of transmission gears including at least a first and a second driven gear spaced along the output shaft, said at least one of the gears comprising the first driven gear, said first and second driven gears being coupled relative to each other so that the second driven gear is shiftable with the first driven gear relative to the input shaft, said first drive gear and said first driven gear intermeshing when the first driven gear is in the first position, said second drive gear and said second driven gear intermeshing when the first driven gear is in the second position, said transmission further including a gear bumper for selective rotation of at least one of said input and output shafts to facilitate intermeshing between the corresponding drive and driven gears, said gear bumper including an alignment gear fixed relative to the output shaft, said gear bumper further including a spring biased rotatable shaft presenting opposed ends and a bumper gear fixed relative to one of said ends, said spring biased shaft being shiftable into and out of an alignment position wherein the alignment and bumper gears intermesh.

2. The pump assembly as claimed in claim 1, said motor comprising an electric motor switchable into and out of an on position wherein the drive shaft rotates at a constant speed.

3. The pump assembly as claimed in claim 1, said transmission further including a shifting assembly operable to shift the first and second driven gears between the first and second positions, said shifting assembly including a rotatable actuator shaft and a gear key shiftable relative to said output shaft, said gear key being operably coupled relative to the actuator shaft so that rotation of the actuator shaft causes the gear key to shift, at least a portion of said gear key being disposed between the first and second driven gears.

4. The pump assembly as claimed in claim 1, said portable housing including a frame having a handle and at least a pair of wheels rotatably coupled relative to the frame.

5. The pump assembly as claimed in claim 1, said pump comprising a positive displacement pump.

6. The pump assembly as claimed in claim 5, said motor generating less than about five horsepower of power, said pumping assembly including at least one hose in fluid communication with the pump and operable to receive a rate of fluid flow there through when the pump is operating, said pump being operable to transfer no more than about one hundred gallons of a fluid per minute through said hose and the rate of flow through the hose varying by less than about forty gallons per minute as the speed of operation of the pump vanes.

7. A portable bulk transfer pump assembly comprising:

a portable housing including a frame having a handle and at least a pair of wheels rotatably coupled relative to the frame; and a pumping assembly supported on the housing, said pumping assembly including a pump and a drive assembly drivingly coupled to said pump, said pump including a rotatable driven shaft, said drive assembly including a motor having a rotatable drive shaft, said drive assembly further including a variable speed transmission drivingly coupling the drive shaft to the driven shaft, said transmission including at least one rotatable transmission shaft and a plurality of transmission gears, at least one of the gears being shiftable relative to the transmission shaft between a first position wherein the transmission shaft rotates at a first speed and a second position wherein the transmission shaft rotates at a second speed, said first and second speeds being different, said at least one rotatable transmission shaft comprising an input shaft coupled to the drive shaft, said plurality of transmission gears including at least a first and a second drive gear spaced along the transmission shaft, said transmission further including a rotatable output shaft coupled to the driven shaft, said plurality of transmission gears including at least a first and a second driven gear spaced along the output shaft, said at least one of the gears comprising the first driven gear, said first and second driven gears being coupled relative to each other so that the second driven gear is shiftable with the first driven gear relative to the input shaft, said first drive gear and said first driven gear intermeshing when the first driven gear is in the first position, said second drive gear and said second driven gear intermeshing when the first driven gear is in the second position, said transmission further including a gear bumper for selective rotation of at least one of said input and output shafts to facilitate intermeshing between the corresponding drive and driven gears, said gear bumper including an alignment gear fixed relative to the output shaft, said gear bumper further including a spring biased rotatable shaft presenting opposed ends and a bumper gear fixed relative to one of said ends, said spring biased shaft being shiftable into and out of an alignment position wherein the alignment and bumper gears intermesh.

8. The pump assembly as claimed in claim 7, said motor comprising an electric motor switchable into and out of an on position wherein the drive shaft rotates at a constant speed.

9. The pump assembly as claimed in claim 7, said transmission further including a shifting assembly operable to shift the first and second driven gears between the first and second positions, said shifting assembly including a rotatable actuator shaft and a gear key shiftable relative to said output shaft, said gear key being operably coupled relative to the actuator shaft so that rotation of the actuator shaft causes the gear key to shift, at least a portion of said gear key being disposed between the first and second driven gears.

10. The pump assembly as claimed in claim 7, said pump comprising a positive displacement pump.

11. The pump assembly as claimed in claim 10, said motor generating less than about five horsepower of power, said pumping assembly including at least one hose in fluid communication with the pump and operable to receive a rate of fluid flow there through when the pump is operating, said pump being operable to transfer no more than about one hundred gallons of a fluid per minute through said hose and the rate of flow through the hose varying by less than about forty gallons per minute as the speed of operation of the pump varies.

12. A portable bulk transfer pump assembly comprising:

a portable housing; and a pumping assembly carried by said housing, said pumping assembly including a pump adapted to be operated at varying speeds and a drive assembly drivingly coupled to said pump, said pump including a rotatable driven shaft, said drive assembly being selectively adjustable to operate the pump at varying speeds and including a motor having a rotatable drive shaft and a variable speed transmission drivingly coupling the drive shaft to the driven shaft, said transmission including at least one rotatable transmission shaft and a plurality of transmission gears, at least one of the gears being shiftable relative to the transmission shaft between a first position wherein the transmission shaft rotates at a first speed and a second position wherein the transmission shaft rotates at a second speed, said first and second speeds being different, said at least one rotatable transmission shaft comprising an input shaft coupled to the drive shaft, said plurality of transmission gears including at least a first and a second drive gear spaced along the transmission shaft, said transmission further including a rotatable output shaft coupled to the driven shaft, said plurality of transmission gears including at least a first and a second driven gear spaced along the output shaft, said at least one of the gears comprising the first driven gear, said first and second driven gears being coupled relative to each other so that the second driven gear is shiftable with the first driven gear relative to the input shaft, said first drive gear and said first driven gear intermeshing when the first driven gear is in the first position, said second drive gear and said second driven gear intermeshing when the first driven gear is in the second position, said transmission further including a gear bumper for selective rotation of at least one of said input and output shafts to facilitate intermeshing between the corresponding drive and driven gears, said gear bumper including a bumper shaft, a bumper gear at a distal end of the shaft, and an alignment gear fixed to the input shaft for rotation therewith.

13. The pump assembly as claimed in claim 12, said gear bumper operable to be manipulated such that the bumper gear intermeshes with the alignment gear to present an aligned position.

* * * * *